US007212077B2

(12) United States Patent
Schilling et al.

(10) Patent No.: US 7,212,077 B2
(45) Date of Patent: May 1, 2007

(54) DEVICE FOR TRANSMITTING SIGNALS BETWEEN MOVABLE UNITS

(75) Inventors: Harry Schilling, Eichstatt (DE); Georg Lohr, Eichenau (DE)

(73) Assignee: Schleifring und Apparatebau GmbH, Fuerstenfeldbruck (DE)

( * ) Notice: Subject to any disclaimer, the term of this patent is extended or adjusted under 35 U.S.C. 154(b) by 0 days.

(21) Appl. No.: 10/918,549

(22) Filed: Aug. 13, 2004

(65) Prior Publication Data

US 2005/0040917 A1 Feb. 24, 2005

Related U.S. Application Data

(63) Continuation of application No. PCT/DE03/00455, filed on Feb. 14, 2003.

(30) Foreign Application Priority Data

Feb. 14, 2002 (DE) ..... 102 06 160

(51) Int. Cl.
*H01P 1/06* (2006.01)
*H01P 5/12* (2006.01)

(52) U.S. Cl. ..... 333/24 R; 333/32; 333/109; 333/111

(58) Field of Classification Search ..... 333/24 R, 333/109, 111, 32, 238, 246
See application file for complete search history.

(56) References Cited

U.S. PATENT DOCUMENTS 4,516,097 A * 5/1985 Munson et al. ..... 333/261
4,973,972 A 11/1990 Huang
5,027,088 A * 6/1991 Shimizu et al. ..... 333/1
5,140,696 A * 8/1992 Fox ..... 455/41.1
5,160,936 A 11/1992 Braun et al.
5,208,581 A 5/1993 Collins
5,287,117 A 2/1994 Posluszny
5,530,422 A 6/1996 Harrison
5,576,710 A * 11/1996 Broderick et al. ..... 342/1
5,892,411 A * 4/1999 Schwan et al. ..... 333/261

(Continued)

FOREIGN PATENT DOCUMENTS

DE 44 12 958 10/1995

(Continued)

OTHER PUBLICATIONS

International Search Report, PCT/DE03/00455, published Aug. 21, 2003.

*Primary Examiner*—Benny Lee
*Assistant Examiner*—Kimberly E Glenn
(74) *Attorney, Agent, or Firm*—Kevin L. Daffer; Daffer McDaniel, LLP

(57) ABSTRACT

A device for signal transmission between units that are movable along given tracks comprises at least one transmitter for generating electrical signals, at least one conductor arrangement for conducting the electrical signals along a track of movement, and at least one receiver for coupling out electrical signals from a conductor arrangement. At least one conductor arrangement comprises at least one conductor structure for conducting electrical signals, an electric reference surface assigned thereto, and at least one dielectric between the conductor structure and the reference surface. A dielectric of the kind used has a high homogeneity, or a high symmetry with respect to the electrical center of the longitudinal axis of the conductor structure, or both.

37 Claims, 3 Drawing Sheets

U.S. PATENT DOCUMENTS

| | | | | |
|---|---|---|---|---|
| 5,936,203 | A | 8/1999 | Ryman | |
| 6,518,864 | B1 * | 2/2003 | Ito et al. | 333/238 |
| 6,649,554 | B1 * | 11/2003 | Chang et al. | 501/137 |
| 6,825,737 | B2 * | 11/2004 | Lohr | 333/24 R |
| 2002/0000936 | A1 | 1/2002 | Sheen | |

FOREIGN PATENT DOCUMENTS

| | | |
|---|---|---|
| GB | 2 131 232 | 6/1984 |
| WO | 98/29919 | 7/1998 |

* cited by examiner

DEVICE FOR TRANSMITTING SIGNALS BETWEEN MOVABLE UNITS

CROSS-REFERENCE TO RELATED APPLICATIONS

This application is a continuation of pending International Application No. PCT/DE03/00455 filed on Feb. 14, 2003, which designates the United States and claims priority from pending German Application No. 102 06 160.2 filed on Feb. 14, 2002.

FIELD OF THE INVENTION

This invention relates to a device for transmitting electrical signals or energy between units movable relative to each other.

For the sake of overall clearness, this document makes no distinction between transmission between units that are movable relative to each other, and transmission between a fixed unit and units movable relative thereto, because this is merely a question of positional reference and does not affect the manner of operation of the invention. In the same way, no detailed distinction is made between a transmission of signals and of energy, because here the mechanisms of operation are the same.

DESCRIPTION OF THE PRIOR ART

With linearly movable units such as crane and conveyer systems, and also with rotating units such as radar installations or even computer tomographs, it is necessary to transmit electrical signals or energy between units which are rotatable relative to each other. A suitable device for this has been described in German laid-open print DE 44 12 958 A1. Here the signal to be transmitted is fed into a strip conductor line of a first unit that is disposed to be movable along a path of movement of units that are movable relative to each other. The signal is tapped off by a second unit by means of capacitive or inductive coupling. An improved device for transmission, as described for example in WO 98/29919, is based on a specific conductor structure that simultaneously has filtering capabilities. Structures of this kind may be used to create extremely broadband transmission systems in the range of a few MHz up to GHz. In the following expositions, the term conductor structures relates to all conceivable forms of conductor structures which are suitable for conducting electrical signals. The signals are coupled out in the near field of the conductor structure. In the ideal case, the coupling out of signals should occur exclusively within the domain of the second unit. As distinct from the case of known leakage conductors, a further emission of signals in other domains of the conductor structure is usually not desired, because the broadband signal can lead to interferences in other instrument parts or instruments.

The principles of design and dimensioning of leakage lines, such as are described for example in U.S. Pat. No. 5,936,203, are not applicable to conductor structures of this kind. Leakage lines are specifically designed to radiate a certain proportion of the carried high-frequency energy outwards from along the entire length. However, this is exactly what is to be avoided here.

Technically similar to a non-contacting coupling out of signals is also a contacting coupling out of signals. A non-contacting coupling out is, however, usually preferred, because it is more reliable and needs no maintenance.

The conductor structures described here may be designed to be optionally contacting or also non-contacting. For this, of course, adaptations are possible according to the purpose of transmission. Thus, for contacting transmission a conductor structure may have an especially well-conducting surface, for example with a silver coating. Contrary to this, for non-contacting transmission a conductor structure may be provided with a lacquer layer on the surface as a protection from corrosion. In these cases, however, the basic principles for designing the conductor structures are the same. A particular design of a contacting transmission device is described in U.S. Pat. No. 5,208,581. An unsymmetrical conductor system is also described here. Although here the geometry is symmetrical, the conductor system is supplied with an unsymmetrical signal. A signal flow from a transmitter to a receiver proceeds via a middle conductor, and returns partially via one or two outside conductors, and also via a computer tomograph system itself. Here the reference surface is the instrument itself. The geometry of the reference surface is here not configured to be unequivocally symmetrical. Because of the unsymmetrical signals which have no unequivocally defined signal path, and the undefined reference surface, this system radiates large HF power. Already at data rates of 50 Mbaud, the current EMC Standards can no longer be observed without additional, costly screening.

The conductor arrangements here used for transmission are usually constructed to be strip lines or conductor structures by means of double-sided conductor plates. A glass-fiber reinforced plastic material usually serves as a support and a dielectric. This support is provided on one side with a continuous conductor surface as an electric reference surface or ground, and on the other side with a strip-shaped conductor or the conductor structure.

The most difficult technical problems with transmission systems of this kind include an attainment of high immunity to interference and also of low emission of radiation. Now, in order to achieve a particularly low-interference signal transmission, for example two parallel lines or conductor structures are supplied symmetrically with a differential signal. By this means the far field becomes approximately zero, at least for conductor intervals that are smaller than the wavelength. Thus, only extremely low energy is radiated. In the opposite case, when an undesired coupling in of electromagnetic waves from the outside occurs, the same signal is produced in both conductors. This can now be filtered off by a receiving circuit having a high common mode rejection. For a high immunity to interference, symmetry of the entire arrangement is essential.

For increasing immunity to interference, normally the signal level of the transmitter cannot be increased as desired. Despite higher symmetry, slight emission of radiation will always occur. With increase of symmetry, the radiation becomes less, and signal levels can be further increased.

At high bandwidths or data rates in the range of a few 100 MHz to several GHz, attenuations and distortions of the signals arise, that can no longer be neglected. Thus, with usual conductor materials and a frequency of 1 GHz, attenuations of the order of 10 dB per meter have been measured. With great lengths, this leads to unacceptable attenuations. Furthermore, there is an increased danger of non-symmetries. Frequently the conductors or conductor structures are fabricated to have lengths from several millimeters to centimeters, so that mechanical tolerances along the track between the movable parts may well be a few millimeters, without the signal transmission being affected. Wide conductor structures of this kind are particularly sensitive to changes of the properties of the dielectric. Thus, especially high demands are made concerning the homogeneity of the dielectric, because changes of thickness, dielectric constant, and also loss factor detrimentally affect the propagation of the signal, the symmetry, and also the emission properties. Therefore, the dielectric must be very homogeneous along the length and particularly along the width of the arrangement. Standard printed board materials by no means satisfy these requirements. Even special printed board materials, as employed for high-frequency technology printed boards, are often unsuitable here. During their normal use in printed boards of small geometry, such as for example 50 mm by 50 mm, and strip conductors having widths of about 1 mm, the variations of the material properties are hardly of significance. Materials which are suitable in accordance with prior art, such as specific materials, in particular homogeneous Teflon or ceramic materials, give rise to problems in processing and are very expensive. However, the main problem with materials of this kind is that they are not available having the required large lengths of several meters. At the most, they can be supplied having typical plate sizes of 50 cm by 50 cm. Thus, new fabrication processes would have to be developed for producing conductor arrangements of large lengths with the previously described high-quality materials. As an alternative to this, short segments of the conductor arrangement could be joined together lengthwise. The connecting positions or soldered joints needed for this cause a high fabrication outlay, mostly result in reflections and non-symmetries at the locations of the joints, and substantially reduce the reliability of the entire conductor arrangement.

A solution for avoiding these problems from the outset is given in U.S. Pat. No. 5,287,117. In this, the conductor arrangement is replaced by a plurality of small antenna segments. These may be produced on printed boards of small area using high quality materials. Signal supply across long distances may be effected with high-quality coaxial cables having high screening and low attenuation. Here too, however, the large number of antenna segments leads to large requirements of material and, in particular, a high need of assembly work, resulting in high fabrication costs.

BRIEF SUMMARY OF THE INVENTION

The problem arises of providing a broadband and low-cost device for signal transmission, that has a conductor arrangement with conductors or conductor structures, and that attains a high symmetry of the signal and also low attenuation values even at high frequencies.

In accordance with the invention, the problem is solved by a device for signal transmission between units movable along given tracks, comprising at least one transmitter for generating electrical signals; at least one conductor arrangement for guiding at least one of the electrical signals of at least one transmitter along a track of movement; and at least one receiver for coupling out electrical signals from at least one conductor arrangement; in which at least one conductor arrangement comprises at least one conductor structure for conducting electrical signals; at least one electrically conducting reference surface assigned to each conductor structure; and also at least one dielectric between the conductor structure and the reference surface; wherein at least one dielectric is provided that has a high homogeneity or a high symmetry with respect to the electrical center of the longitudinal axis of the conductor structure, or both.

A device for signal transmission in accordance with the invention comprises at least one transmitter for generating and feeding into a conductor structure the electrical signals to be transmitted. At least one such conductor arrangement is disposed along the track of the movement and carries the signals fed in from the transmitter. At least one receiver, disposed to be movable relative to the transmitter and the conductor arrangement, serves to couple out the signals from the conductor arrangement. According to the particular case of use, a transmitter may also feed a plurality of conductor arrangements. In the same way, a conductor arrangement may be fed by a plurality of transmitters. Furthermore, it is possible to employ a desired number of receivers for coupling out signals at a conductor arrangement.

A conductor arrangement comprises at least one conductor structure in which electrical signals may be carried. A conductor structure of this kind contains one or a plurality of conductors, preferably of a well conducting material.

Furthermore, a conductor arrangement comprises at least one electrically conducting reference surface assigned to each conductor structure. At least one dielectric is located between the conductor structure and the reference surface for insulating the conductor structure and the reference surface. A dielectric of this kind may optionally have a high homogeneity, or a high symmetry with respect to the electrical center of the longitudinal axis of the conductor structure. Here the concept of symmetry relates to a symmetry of the electric field. Starting out from the electrical center of the conductor structure, the electric field lines should extend symmetrically. This can be achieved, for example, with an arrangement having mirror symmetry. Similarly, however, other ways of achievement are conceivable, such as, for example, in the case of a layered dielectric having conductors parallel to the reference surface. Basically, here the order of the layers of dielectric may be different for the conductors, when the entire dielectric constants on both sides are the same, and also the surfaces are of equal sizes.

The symmetry of the electric field is referred to an equipotential surface having a potential corresponding to the mean potential between the live conductors, i.e. those used for carrying signals.

A high homogeneity here means that the electrical properties, in particular the dielectric constants and also the dielectric losses, are subject to only small fluctuations. Typical values of tolerances of these values are <5%, and preferably <1%. If particularly exacting demands are made, then tolerances of 0.1% also may be appropriate. If the fabrication results in different homogeneities of the dielectric along different directions, then the greatest homogeneity should be provided perpendicularly to the direction of the longitudinal axis of the conductor structure. Lesser homogeneities may be tolerated along the direction of the longitudinal axis. Here it is essential that in accordance with the preceding considerations concerning symmetry at each point along the longitudinal axis of the conductor structure, there should be symmetry, and in an according manner the properties of the dielectric should be symmetrical.

This relatively complex concept of symmetry will be explained by means of a simple example. A conductor structure of two parallel, equally wide and equally thick conductors will be taken as a starting point. The electrical center of the longitudinal axis of the conductor structure is here exactly in the middle between the conductors. Now, for each infinitesimally short length along this conductor structure, the electrical parameters of the dielectric shall be equal for both conductors. In considering such a short length of the conductor, it is immaterial which layer arrangement, or which composition of the dielectric, results in a particular dielectric constant or a particular loss factor. It is essential that these values be the same for both short lengths of the conductor. Along the remaining extent of the conductor, changes of the values from those for the preceding partial lengths can be tolerated, provided that they are the same for both conductors. Thus, a high symmetry can be achieved together with the desired electrical properties.

With symmetrical conductors, or with an unsymmetrical conductor system having a plurality of conductors, a high symmetry with respect to the electrical center of the longitudinal axis of the conductor structure prevents the signals from becoming unsymmetrical as a result of different transit times or attenuations.

Ideally a dielectric of high homogeneity and high symmetry is used. With this, according to experience, the best results can be produced with justifiable outlay. If a symmetrical arrangement of the dielectric cannot be achieved, then even the use of a dielectric of high homogeneity can bring about a significant improvement. Similarly, a symmetrical arrangement will bring about an improvement, even when no adequate homogeneity of the dielectric can be achieved.

The conductor structure is mainly open to free space on one side. A coupling-on of receivers is effected from this side. The opposite side, and optionally also its boundary, are closed off by faces that are as symmetrical as possible and have a conducting surface. With this, on the one hand, a defined impedance of the conductor system can be achieved, and on the other hand, a defined symmetrical boundary can be obtained. If there were no defined reference surface here, then at least a part of the instrument in which the device is mounted would serve as an electrical reference. Here the necessary symmetry would certainly not be achieved along the entire length of the conductor structure, because various structural components or structural groups of the instrument could not be disposed as symmetrically as desired.

In another advantageous embodiment of the invention, at least one dielectric comprises an air or gas layer.

Most of the known technically usable gases, in particular air that is a varying combination of various gases with a high proportion of nitrogen, possess similar dielectric properties with a relative dielectric constant close to 1, and an almost negligible loss factor. Therefore, in this document reference will be made only to air or an air layer as a dielectric. Included in this are also mixtures of several different gases having electrical properties similar to those of air. Instead of air, liquids having very low loss factors may also be used.

Essential for the operation is the low dielectric loss factor of the gases. Thus, fluctuations of the loss factor have only small effects.

If the attenuation is small, then for the same tolerance of the attenuation it will have a substantially smaller effect on the tolerance of the signal level than a high-value attenuation. This will be illustrated with an example. If a certain material having a given geometry causes an attenuation of the signal by 10% with a tolerance of ±10% of the attenuation, then the actual attenuation value may fluctuate between 9% and 11%. The level of the attenuated signal is thus 9% to 11% lower than that of the original signal. Now the signal level may vary by 2%, depending on the actual attenuation value. If by comparison with this, the attenuation of the material is only 1% with the same tolerance of ±10% of the attenuation, then the signal level may be attenuated by between 0.9% and 1.1% compared with the original signal.

Thus, in this case the signal level can vary by only 0.2%, depending on the actual attenuation value. Furthermore, owing to the small attenuation value, the amplitude of the signal is only minutely attenuated even with long conductor structures. Owing to a uniformly high signal level, the receiver is required to have only a small dynamic ratio. At the same time, the immunity to interference may be maximized, because the maximum possible input level is always available at the receiver.

In another advantageous embodiment of the invention at least one dielectric comprises a honeycombed or grid-shaped structure of an insulating material. The intermediate or hollow spaces are filled with air. Basically, other hollow structures suitable for accommodating air are also usable.

In the case of hollow structures of this kind, the dielectric consists of a combination of the insulating material usually having a higher dielectric constant than air, and a higher loss factor than air. The electric field now preferably extends through stays of insulating material bridging the gap between the conductors or the conductors and the reference surface. These stays should therefore be designed to have as small as possible a cross-section. In the major portion of the entire surface the electric field will extend through insulating material and air, connected in series. Here the superb electrical properties of the air will dominate, because a higher field strength that is inversely proportional to the dielectric constant is applied to the air paths.

In another improved embodiment of the invention, at least one dielectric comprises an insulating material foam. The hollow spaces of the foam are filled with air. Naturally, with a foam, extremely thin wall thicknesses of the insulating material and therewith extremely small bridge cross-sections may be attained. Thus, the area bridged by the insulating material without air being interposed is substantially smaller than with honeycombed or grid structures. In addition, foams can be produced and processed at low cost. As an alternative to foams, granulates or air-filled hollow spheres may be employed.

Another advantageous embodiment of the invention consists in at least one dielectric comprising a polyethylene foam. Polyethylene is a plastic with superb electrical properties. It is one of the insulating materials having the lowest loss factors. At the same time, low cost foams can be produced with this material. Processing thereof, especially when it is in the form of thin films having thicknesses of a few millimeters, is particularly simple and inexpensive.

Another advantageous embodiment comprises a dielectric which is a multi-layer assembly. With a multi-layer assembly of this kind, different dielectrics having, for example, different electrical and mechanical properties may be combined. Thus, thin stays of mechanically stable insulating material combined with large-area arrangements of dielectrics that enclose air are of special advantage.

In another advantageous embodiment of the invention, at least one dielectric is an assembly of a plurality of layers arranged to be parallel to the conductor structure. With a parallel layer structure of this kind, even large-area insulating materials having poor electrical properties may be combined with insulating materials having good electrical properties, particularly when these have a low dielectric constant. Thus, relatively good electrical properties may still be obtained with the combination.

An especially advantageous embodiment of the invention consists in a dielectric that encloses air and therefore is of only small mechanical stability being combined with at least one second insulating material to give a massive type of construction of correspondingly higher stability. Thus, this second insulating material can be used to stabilize a combination of various dielectrics. This makes possible a precise fixing of the position of the dielectrics which is absolutely necessary for high symmetry, irrespective of the poorer mechanical properties of the first layer.

In another advantageous embodiment of the invention, the second layer is designed to be a mechanically rigid layer in order to fix or stabilize the first layer to which it is joined. A joining of this kind can be effected, for example, by form-locking or also by means of an adhesive. With an embodiment of this kind, not only a higher stability, but also a precisely defined geometry is obtained. In addition, the fabrication process can be simplified when all layers of a dielectric can be commonly prefabricated and finally assembled as a unit.

Another advantageous embodiment of the invention consists in the second layer being designed also as a support for the conductor structure. By means of this, all components of the electrical system of the conductor arrangement are joined together as one unit and can be assembled with the smallest of tolerances extremely cheaply.

Another advantageous embodiment of the invention consists in the provision of at least one additional layer of conductive material, or material having a high conductivity and incomplete coverage of area, such as for example a grid structure. Layers of this kind act as equipotential surfaces and help to even out non-symmetries within the dielectric. According to the design or arrangement of the surfaces, these are arranged to be electrically insulated, or also closed-off at the ends of the conductor structure to be free of reflection.

In another advantageous embodiment, at least one dielectric comprises an assembly of a plurality of layers disposed to be perpendicular to the conductor structure. Layers of this kind may be used, for example, as supports for the conductor structure.

Furthermore, of advantage is a design of these layers to be symmetrical to the electrical center of the longitudinal axis of the conductor structure. By this means the symmetry is maintained.

Another advantageous embodiment of the invention consists in that in a dielectric of a first material containing air, layers of a second, mechanically rigid insulating material, disposed to be perpendicular to the conductor structure, are provided. Thus, the electrical properties of the arrangement are predominantly determined by the large-surface first material. The second material is provided as a support for fixing the conductor structure and stabilizing the first material in case this is, for example, a foam or a hollow body. Of course, the cross-sectional area of the supports consisting of the second material should be as small as possible in order to affect the field as little as possible. Furthermore, the supports may be disposed at irregular intervals in order to prevent resonances on the conductor system.

In another advantageous embodiment, the part carrying the conductor structure has a groove for accommodating at least one dielectric. With the aid of a groove of this kind, the dielectric can be fixed in position simply and at low cost during fabrication.

Another embodiment provides for the groove for accommodating at least one dielectric to be simultaneously intended for fixing the conductor structure.

In an especially advantageous embodiment of the invention, the conductor structure comprises a symmetrical conductor system. Symmetrical conductor systems of this kind can be made to have a particularly low level of emitted radiation. Especially with a symmetrical design of the conductor system, and during operation with symmetrical electrical signals, the electric fields and the magnetic fields of the conductors cancel out at a distance. Conductor systems of this kind having two conductors are preferably used. For further details, attention is drawn to the disclosure of U.S. Pat. No. 5,530,422, and also to the International Publication WO 98/29919.

In another embodiment of the invention, the conductor structure comprises a non-symmetrical conductor system. There are special cases of non-symmetrical conductor systems in which an emission of radiation may nevertheless be kept low. An example of this is the system illustrated in U.S. Pat. No. 5,208,581. In this, current flows through different conductor systems according to signal polarity. However, in most cases of non-symmetrical conductor systems, substantially higher technical outlay is needed for interference suppression than in cases of symmetrical conductor systems.

In the following the invention will be described by way of example, without limitation of the general inventive concept, with the aid of examples of embodiment and reference to the drawings.

DETAILED DESCRIPTION OF THE INVENTION

Figure 1:
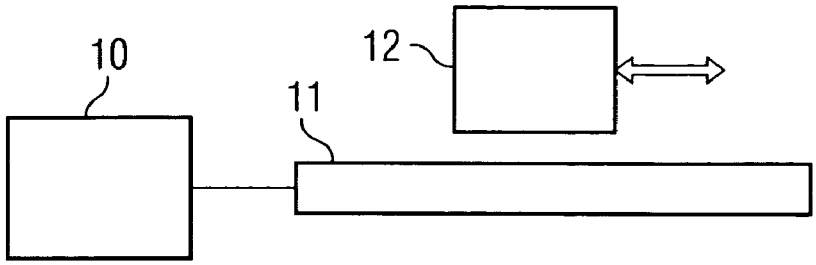
FIG. 1 schematically shows in general form a device according to the invention.

In FIG. 1 a device according to the invention is illustrated as an example. A transmitter 10 feeds electrical signals into the conductor arrangement 11. The receiver 12 is movably disposed opposite to the conductor arrangement 11 and the transmitter 10 connected thereto. The relative movement occurs along given tracks. Tracks of this kind may be linear or also circular, for example. The conductor arrangement 11 is disposed along at least one of these tracks of movement, so that at each point of the movement from which signals are to be transmitted there is only a short distance between the conductor arrangement 11 and the receiver 12. Typically the distances are within a range of 0.1 mm to about 10 mm. Direct contact at a distance of 0 is possible. This is a case of transmission via electrical contact. In order to maintain a long service life of the contact system here, it is necessary for the surfaces to be of special design. However, in a normal case the transmission is desired to be non-contacting, and thus to involve little wear. Separations greater than about 10 mm are not ruled out, but are not desired in most cases, because an emission of radiation from the entire conductor arrangement 11 is required to be so low that no interference with, or effect on, other instrument components or instruments occurs. Therefore the transmission system is specifically designed so that the electromagnetic far field of the conductor arrangement 11 is as small as possible, and equal to 0 in an ideal case.

Figure 2:
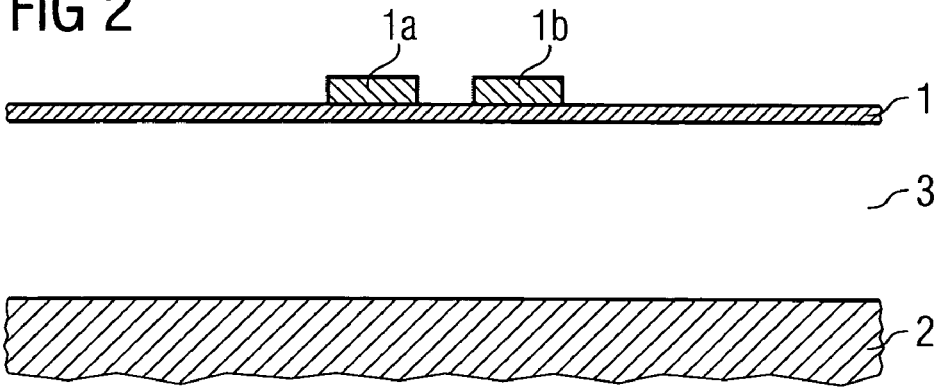
FIG. 2 shows by way of example an embodiment of a conductor arrangement.

FIG. 2 shows as an example a particularly simple embodiment of a conductor arrangement 11. The conductor arrangement comprises at least one conductor structure 1 and also a reference surface 2 assigned thereto, and a dielectric 3. For better illustration, two conductors 1*a* and 1*b* have been shown in the conductor structure 1. These conductors may extend in any desired manner known from prior art. The reference surface 2 itself is electrically conducting, at least on the surface thereof. In this example, a hollow space filled with air or a similar gas is located between the conductor structure 1 and the reference surface 2. Therefore, in this case the air is the dielectric.

Figure 3:
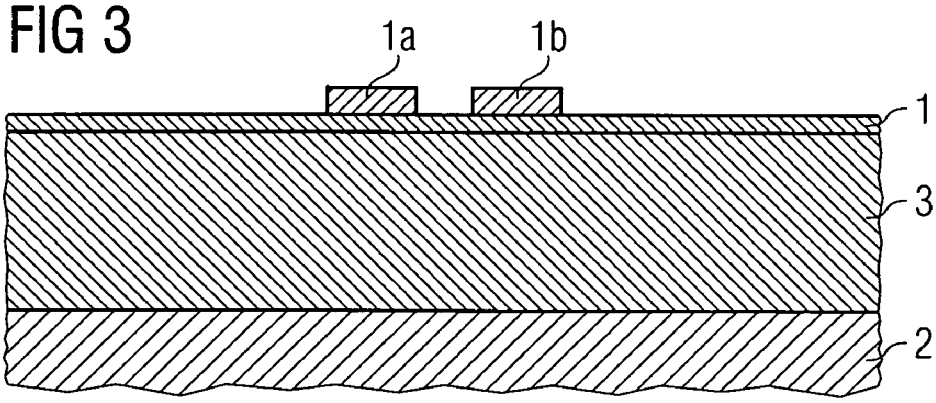
FIG. 3 shows by way of example an embodiment of a conductor arrangement with a dielectric containing at least solid materials.

FIG. 3 shows as a example an embodiment of a conductor arrangement 11 according to FIG. 2, the hollow space between the conductor structure 1 and the reference surface 2 being filled with a dielectric 3 consisting at least partly of solid materials. Dielectrics of this kind may be, for example, grid structures or also foams of an insulating material.

Figure 4:
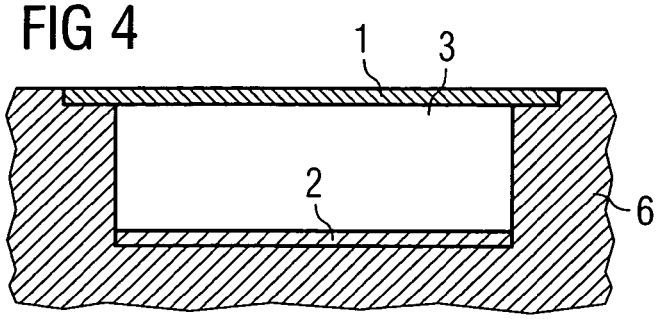
FIG. 4 shows an arrangement with a support of insulating material.

FIG. 4 shows an arrangement in which the conductor structure 1 is fixed in a support 6 of insulating material. A groove is provided in the support for accommodating the dielectric 3 and the reference surface 2. In this case the reference surface 2 is designed as an electrically conducting surface at the bottom of the groove. An electrically conducting surface of this kind may be made, for example, by means of a conducting lacquer or a thin strip of foil. A foil strip of this kind may be attached by adhesion, but also by adhesive means such as double-sided adhesive tape. Owing to the comparatively robust attachment in a massive support, the geometry and therewith also the symmetry of the arrangement is precisely defined and stably fixed for a long period of time.

Figure 5:
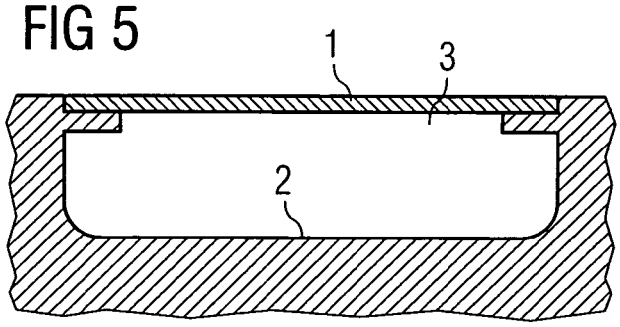
FIG. 5 shows an arrangement with a conducting support.

In FIG. 5 an arrangement with a conductive support is shown. This conductive support has a groove for accommodating the dielectric and with its surface fulfills the function of the reference surface 2. Optionally, the surface on the inside of the groove may be finished in order to obtain a well-conducting surface that is stable for a long time. Furthermore, the groove may be so formed that it is adapted precisely to accommodate the conductor structure 1. With this embodiment, in most cases the geometry can be defined more precisely than with a conducting support and an additional reference surface, because here there are no tolerances of the adhesion or thickness tolerances of the additional reference surface. Furthermore, with this embodiment there is a greater degree of freedom for shaping the groove itself. This can now be optimized, also in view of low-cost fabrication, because here no additional conductor need be inserted as a reference surface.

Figure 6:
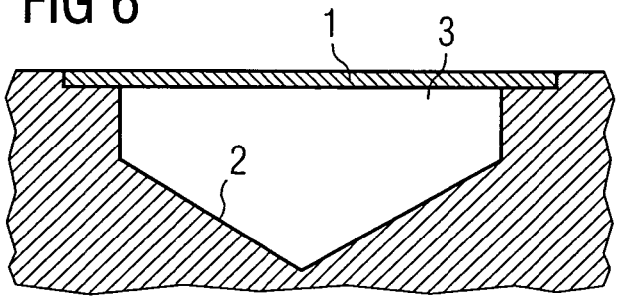
FIG. 6 shows an arrangement in a conducting support having a beveled reference surface.

FIG. 6 shows an embodiment in which the dielectric 3 and also the conductor structure 1 are accommodated in a conductive support. In this, the bottom of the accommodating groove is symmetrically beveled on both sides.

Figure 7:
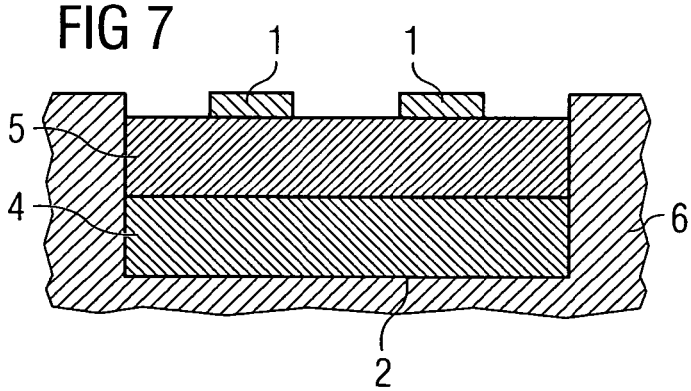
FIG. 7 shows an embodiment with a dielectric in the form of layers disposed to be parallel to the conductor structure and reference surface.

FIG. 7 illustrates an embodiment with a dielectric in the form of layers disposed to be parallel to the conductor structure and reference surface. This is accommodated in a support 6 having a groove formed therein, the inside of which simultaneously serves as a reference surface 1. Here, as an example, the dielectric has a first layer 5 consisting of a massive insulating material. Parallel to this there is a second layer, consisting of a dielectric comprising air or a gas. The first dielectric serves the primary purpose of supporting and fixing in a defined position the conductor structure 1. Precise fixing of the conductor structure in a given position to be symmetrical to the surroundings and, in particular, to the reference surface 2, is essential for a high symmetry of the signals and therewith for a high immunity to interference, or for low interference emission. In order to here attain an adequate mechanical stability, a large layer thickness of the first layer was chosen in this example. The second layer 4 consists of a dielectric having a low dielectric constant and small loss. Owing to the electrical series connection with the first layer having a high dielectric constant, the major proportion of the entire electric field strength, and therewith also of the energy stored in the field, is in the second layer 5 having a low dielectric constant. Because this also has a substantially smaller loss factor, the total loss factor of the arrangement is substantially smaller.

Figure 8:
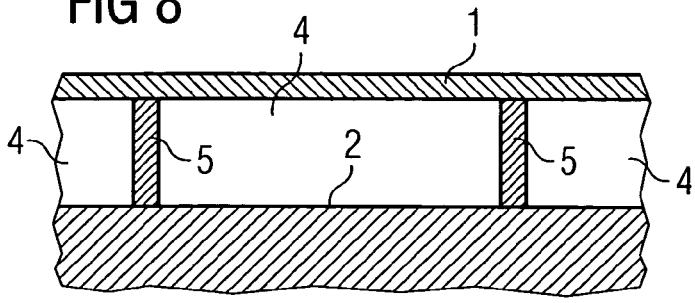
FIG. 8 shows an advantageous embodiment having a dielectric in the form of layers disposed perpendicularly to the conductor structure and reference surface, in a cross-section along a direction of movement.

In FIG. 8 an advantageous embodiment of the invention having a dielectric in the form of layers disposed perpendicularly to the conductor structure and reference surface is shown in a cross-section along a direction of movement. Stays of a massive insulating material 5 are disposed perpendicularly at certain intervals between the conductor structure and the reference surface, in order to ensure a defined alignment of the conductor structure with respect to the reference surface. The intermediate spaces are filled with an insulating material comprising air or a gas. The stays themselves may be disposed at constant or also varying distances from each other. Variable distances help to prevent resonances in the conductor system. Ideally, the stays are designed to be narrow, so that the capacity at the location of the stays is relatively small. With this, the reflections at the locations of these stays may be minimized.

Figure 9:
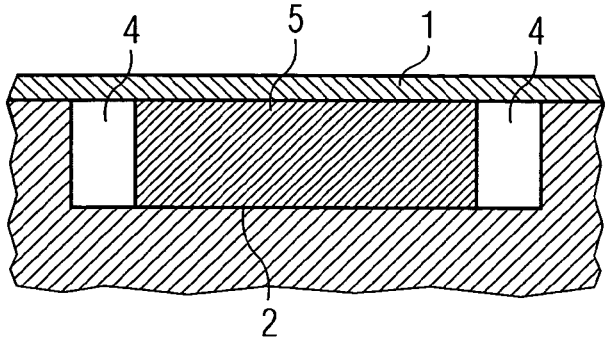
FIG. 9 shows an advantageous design having a dielectric in the form of layers disposed perpendicularly to the conductor structure and reference surface, in a cross-section across a direction of movement.

In FIG. 9 an arrangement according to FIG. 8 is shown in a cross-section perpendicular to a direction of movement. Here the stays have been constructed of massive insulating material in such manner that they do not extend across the entire width of the groove in the support. This leads to a further reduction of losses in the stays. Of course, these stays may also extend across the entire width of the groove for reasons of stability.

Figure 10:
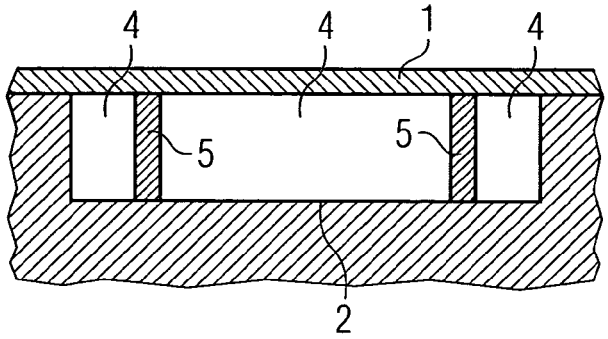
FIG. 10 shows an arrangement having a dielectric in the form of layers disposed perpendicularly to the conductor structure and reference surface, in which the layers are designed as supports along the longitudinal direction of the conductor structure.

FIG. 10 shows an arrangement having vertical layers of the dielectric. In this, the layers are so designed that narrow stays of the first dielectric 5 of massive insulating material are formed along the conductor structure. Thus, no reflections are present in a direction of propagation along the conductor structure. However, here care must be taken to ensure a very symmetrical arrangement and stable fixing of the longitudinal strips, in order to achieve a high symmetry.

Figure 11:
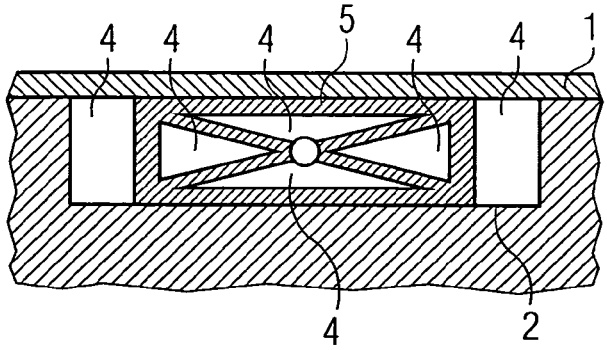
FIG. 11 shows an arrangement having a support of a massive dielectric designed to be of particularly low capacity.

FIG. 11 shows an arrangement having a support of a massive dielectric designed to be of particularly low capacity, in order to minimize reflections at the locations of the stays. Of course, other kinds and designs of stays may be used. Essential is here the mechanical supporting function of a stay. This means that it should be more rigid or stable than the dielectric which substantially derives its properties from air or gas.

LIST OF REFERENCE NUMERALS

1 conductor structure
1*a* first conductor
1*b* second conductor
2 reference surface
3 dielectric (in general)
4 dielectric (comprising air or gas)
5 dielectric of massive insulating material
6 support
10 transmitter
11 conductor arrangement
12 receiver

What is claimed is:

1. Device for signal transmission between units movable along given tracks, comprising:

at least one transmitter for generating electrical signals;

at least one conductor arrangement for guiding at least one of the electrical signals of at least one transmitter along a track of movement; and at least one receiver movable relative to the transmitter along the at least one conductor arrangement for coupling out electrical signals from the at least one conductor arrangement, in which the at least one conductor arrangement comprises:

at least one conductor structure for conducting electrical signals;

at least one electrically conducting reference surface assigned to each conductor structure;

at least one dielectric between the conductor structure and the reference surface;

wherein the at least one dielectric having a high homogeneity or a high symmetry with respect to the electrical center of the longitudinal axis of the conductor structure, or both, is provided; and wherein at least one additional layer of conductive material, or conductive material having an incomplete surface coverage is provided.

2. Device according to claim 1, wherein the at least one dielectric comprises an air layer or a gas layer.

3. Device according to claim 1, wherein the at least one dielectric comprises a honeycomb-shaped or grid-shaped structure of an insulating material, the hollow spaces or intermediate spaces being filled with air or a gas.

4. Device according to claim 1, wherein the at least one dielectric comprises a foam or a granulate of an insulating material, the hollow spaces being filled with air or a gas.

5. Device according to claim 1, wherein the at least one dielectric comprises a polyethylene foam.

6. Device according to claim 1, wherein the at least one dielectric comprises an assembly of a plurality of layers.

7. Device according to claim 1, wherein the at least one dielectric comprises an assembly of a plurality of layers arranged to be parallel to the conductor structure.

8. Device according to claim 1, wherein the at least one dielectric comprises at least one first layer of a first material comprising, or enclosing in hollow spaces, air or a gas, and at least one second layer of at least one massive second insulating material.

9. Device according to claim 8, wherein the at least one second layer is designed to be a mechanically rigid layer for stabilizing or fixing the first layer.

10. Device according to claim 8, wherein the at least one second layer is designed to be a support for the conductor structure.

11. Device according to claim 1, wherein the dielectric comprises an assembly of a plurality of layers arranged to be perpendicular to the conductor structure.

12. Device according to claim 11, wherein the plurality of layers are arranged to be symmetrical to the electrical center of the longitudinal axis of the conductor structure.

13. Device according to claim 1, wherein the at least one dielectric is of a first material comprising air or a gas, and layers of a mechanically rigid insulating material, arranged to be perpendicular to the conductor structure, are provided at given intervals for stabilizing or fixing the conductor structure.

14. Device according to claim 1, wherein a groove for accommodating the at least one dielectric is provided in the part supporting the at least one conductor arrangement.

15. Device according to claim 14, wherein the groove for accommodating the at least one dielectric is also provided for fixing the at least one conductor structure.

16. Device according to claim 1, wherein a groove for fixing the at least one conductor structure is provided in a part supporting the at least one conductor arrangement.

17. Device according to claim 1, wherein the at least one conductor structure comprises a symmetrical conductor system.

18. Device according to claim 1, wherein the at least one conductor structure comprises a non-symmetrical conductor system.

19. Device according to claim 1, wherein the conductive material having an incomplete surface coverage is a grid structure.

20. Device for signal transmission, comprising:

a receiver and a transmitter movable relative to each other along at least one conductor arrangement for coupling out electrical signals from the at least one conductor arrangement, in which the at least one conductor arrangement comprises:

at least one conductor structure for conducting electrical signals;

at least one electrically conducting reference surface assigned to each conductor structure;

at least one dielectric between the conductor structure and the reference surface that comprises a honeycomb-shaped grid, a foam or granulate, or a structure containing air or gas; and wherein the at least one dielectric having a high homogeneity or a high symmetry with respect to the electrical center of the longitudinal axis of the conductor structure, or both, is provided.

21. Device for signal transmission between units movable along given tracks, comprising:

at least one transmitter for generating electrical signals;

at least one conductor arrangement for guiding at least one of the electrical signals of at least one transmitter along a track of movement; and at least one receiver movable relative to the transmitter along the at least one conductor arrangement for coupling out electrical signals from the at least one conductor arrangement, in which the at least one conductor arrangement comprises:

at least one conductor structure for conducting electrical signals;

at least one electrically conducting reference surface assigned to each conductor structure;

at least one dielectric that comprises an assembly of a plurality of layers between the conductor structure and the reference surface; and wherein the at least one dielectric having a high homogeneity or a high symmetry with respect to the electrical center of the longitudinal axis of the conductor structure, or both, is provided.

22. Device according to claim 21, wherein the at least one dielectric comprises an air layer or a gas layer.

23. Device according to claim 21, wherein the at least one dielectric comprises a honeycomb-shaped or grid-shaped structure of an insulating material, the hollow spaces or intermediate spaces being filled with air or a gas.

24. Device according to claim 21, wherein the at least one dielectric comprises a foam or a granulate of an insulating material, the hollow spaces being filled with air or a gas.

25. Device according to claim 21, wherein the at least one dielectric comprises a polyethylene foam.

26. Device according to claim 21, wherein the at least one dielectric comprises an assembly of a plurality of layers arranged to be parallel to the conductor structure.

27. Device according to claim 21, wherein the at least one dielectric comprises at least one first layer of a first material comprising, or enclosing in hollow spaces, air or a gas, and at least one second layer of at least one massive second insulating material.

28. Device according to claim 27, wherein the at least one second layer is designed to be a mechanically rigid layer for stabilizing or fixing the first layer.

29. Device according to claim 27, wherein the at least one second layer is designed to be a support for the conductor structure.

30. Device according to claim 21, wherein at least one additional layer of conductive material, or conductive material having an incomplete surface coverage is provided.

31. Device according to claim 21, wherein the dielectric comprises an assembly of a plurality of layers arranged to be perpendicular to the conductor structure.

32. Device according to claim 31, wherein the plurality of layers are arranged to be symmetrical to the electrical center of the longitudinal axis of the conductor structure.

33. Device according to claim 21, wherein the at least one dielectric is of a first material comprising air or a gas, and layers of a mechanically rigid insulating material, arranged to be perpendicular to the conductor structure, are provided at given intervals for stabilizing or fixing the conductor structure.

34. Device according to claim 21, wherein a groove for accommodating the at least one dielectric is provided in the part supporting the at least one conductor arrangement.

35. Device according to claim 34, wherein the groove for accommodating the at least one dielectric is also provided for fixing the at least one conductor structure.

36. Device according to claim 21, wherein a groove for fixing the at least one conductor structure is provided in a part supporting the at least one conductor arrangement.

37. Device according to claim 21, wherein the at least one conductor structure comprises a non-symmetrical conductor system.

* * * * *